US007023764B2

(12) United States Patent
Wolf et al.

(10) Patent No.: US 7,023,764 B2
(45) Date of Patent: Apr. 4, 2006

(54) CLOCK

(75) Inventors: Gottfried Wolf, Ludgerustr 2, 48653 Coesfield (DE); Michael Sporrer, Bergstr. 9, 40787 Ratingen (DE)

(73) Assignees: Gottfried Wolf, Coesfield (DE); Michael Sporrer, Ratingen (DE)

( * ) Notice: Subject to any disclaimer, the term of this patent is extended or adjusted under 35 U.S.C. 154(b) by 289 days.

(21) Appl. No.: 10/735,563

(22) Filed: Dec. 12, 2003

(65) Prior Publication Data

US 2004/0228221 A1 Nov. 18, 2004

Related U.S. Application Data

(63) Continuation of application No. PCT/EP02/06330, filed on Jun. 10, 2002.

(51) Int. Cl.
*G04B 19/06* (2006.01)

(52) U.S. Cl. ..... 368/228; 368/223

(58) Field of Classification Search ..... 368/80, 368/223–232, 292

See application file for complete search history.

(56) References Cited

U.S. PATENT DOCUMENTS 3,177,646 A * 4/1965 Ernest et al. ..... 368/296
4,884,256 A * 11/1989 Blackburn ..... 368/223
5,103,434 A * 4/1992 Sullivan ..... 368/238
5,305,290 A * 4/1994 Yoo ..... 368/76

* cited by examiner

*Primary Examiner*—Kamand Cuneo
*Assistant Examiner*—Thanh S. Phan
(74) *Attorney, Agent, or Firm*—Sonnenschein Nath & Rosenthal LLP

(57) ABSTRACT

The invention relates to a clock comprising a clock face with hands and clockwork elements. Said clock face comprises a non-rotationally symmetric surface in the direction of rotation of the hands. The inner ends of the hands are rotatably mounted in a displaceable manner around a pivoting axis which extends in a peripheral manner with respect to the peripheral rotational axis of the hands and in a perpendicular manner with respect to the longitudinal axis of the hands. A control element is provided, enabling the hands to be pivoted in such a way that they can be displaced at an equal distance from the surface of the clock face as they go round. Said novel clock is characterized in that the hands on the inner end thereof or near thereto are rotatably mounted around a rotating axis extending in the longitudinal direction of the hands; the hands are flat in the visible region thereof; and a control element is provided, enabling the hands to be rotated around the rotational axis thereof in such a way that they can be displaced parallel to the clock face surface as they go round.

21 Claims, 3 Drawing Sheets

CLOCK

This application is a continuation of international application No. PCT/EP02/06330, filed on Jun. 10, 2002, which claims foreign priority of German application No. DE 101 28 671.6, filed on Jun. 13, 2001.

BACKGROUND OF THE INVENTION

The present invention relates to a clock with a clock face, one or more hands and a clockwork mechanism with one or more concentric motion arbors for moving the hands around a rotary axis in a clockwise direction, whereby the clock face, when viewed in the direction of clock-wise motion, has a surface which is not symmetrical to the rotation, whereby the hands run on bearings at their inner ends facing the axis of rotation of the hands in a clockwise direction, such that the hands can pivot round a pivot axis perpendicular to the axis of rotation in a clockwise direction and perpendicular to a longitudinal axis of the hands, and whereby a control is provided such that the hands can be moved in such a fashion that they rotate over the clock face at an essentially constant distance from the surface of the clock face.

A clock of the type specified above is known from DE-U 299 21 231. Though this known clock provides for the motion of the clock hands over the clock face which is not symmetric when viewed in the direction of rotation by continuously keeping a constant small distance from the clock face, but the selection of hands is significantly restricted. This limitation is caused by the hands being tilted in their rotation only transversely to their longitudinal orientation, which leads to angular errors between the surface of the clock face and the surface of the hands especially in the case of two-dimensional, relatively wide hands such as are generally known, particularly in the case of large clocks. These angular errors can reach such an extent that it is difficult to read the time; moreover, the optical appearance is significantly affected by such angular errors. In practice, therefore, the known clock has narrow, rod-like hands preferably with a circular cross-section such that such angular errors of the type described above do not become apparent. However, these narrow, rod-like hands have a thin appearance which is unsatisfactory for the designer of such a clock and significantly restricts the design options. These disadvantages are particularly apparent in large clocks and therefore particularly disturbing.

Thus it is the task of the present invention to provide a clock of the type described above which provides for greater freedom in the geometric design of the hands and which at the same time ensures that the current time can be clearly and precisely represented and read.

SUMMARY OF THE INVENTION

The task is solved in the present invention by a clock of the type described above, characterized in that, the hands can be moved, at or near their inner end close to the axis of rotation in a clock-wise direction, around an additional axis of rotation running along the longitudinal axis of the hand, that the hands are two-dimensional in the areas visible and that an additional control is provided with which the hands can be rotated around their axis of rotation running longitudinally to the hand such that they move essentially parallel to the surface of the clock face during their circular path.

As an essential part of the invention, the bearing arrangements and control of the hands in this clock are such as to ensure that the hands follow the progress of the surface of the face not only at an essentially constant distance but also essentially parallel to the surface. By this means, the use of wider or two-dimensional hands, as is normal for conventional clocks, especially large clocks, is possible. In this, their tilting movement around their longitudinal axis produces a constant parallel position of the hand to the surface of the clock face and an additional impressive optical effect for the observer of the clock. Simultaneously, a continuous, clear and exact representation and reading of the time is guaranteed in spite of the surface of the clock face not being symmetrical to the rotation and in spite of the wide or two-dimensional hands. In this manner the creative freedom for the geometrical design of the clock face and hands is further extended so that clocks can now be created with appearances which were previously not possible.

A development of the invention suggests that the additional control is a rotating control arranged in the center of the clock and which forms a mechanical cam for each hand, the course of the curve of which is made corresponding to the course of the surface of the clock face when viewed in the clockwise direction, that each mechanical cam is formed by a stationary drive disk or drive drum with a control groove, such discs or drums being concentric with the relevant motion arbor and that a control lever in every control groove is restrained by the groove, the lever being linked to the relevant hand, whereby the relevant hand during its circular movement over the clock face is tilted around its longitudinal axis in accordance with the course of the control groove.

The desired pivoting control of the hands around their longitudinal axis is achieved with relatively little additional structural cost by such a mechanical control with a cam whose control groove works in conjunction with a control lever for a hand. The essential point is that the hands require no further bearings and/or guidance outside the clock center and that the hands are not supported by the clock face. Because of the restraint of the control lever, this control needs no return springs and can operate independently of the effects of gravity, which means that the clock can be positioned independently as far as its attachment or installation is concerned. In addition, only limited friction occurs such that a clockwork mechanism with very little power can be used and which is therefore limited in size.

In order to achieve a particularly compact construction, it is therefore foreseen as a matter of preference that the controls for the tilting and the additional controls for the rotation of the hands around their longitudinal axis are combined into a common set of controls. This also achieves a reduction in the number of individual components which will make the manufacture and installation of the control mechanism generally simpler.

In a preferred, concrete arrangement it is foreseen that the common control mechanism for each hand is formed by a calculated mechanical curve for each hand which is in turn formed on or in the cover of a stationary, conical or truncated cone-shaped control component which is concentric with the axis of rotation of the hand over the clock face, and that a control lever for each hand is restrained by means of a pair of curved rollers with two curved rollers separated from each other in the longitudinal direction of the cam, whereby the distance of the cam from the axis of normal rotation of the hands determines the tilting position of the hands, and the gradient of the cam between the two curved rollers of the pair of curved rollers determines the rotational position of the hands in their rotation around their longitudinal axis. Thus one cam per hand provides both its suitable tilting motion and also its rotation relative to the surface of the clock face, in order to guarantee the required constant distance of the hand and the parallel position of the hand and the clock face in every position of the hand as it moves around the clock face.

In order to avoid a collision between the hand and its stationary control body as the hand moves around the clock face and the during the tilting movement which results, it is foreseen that the external radial contour of each conical or truncated cone-shaped control component is shaped in such a manner that it follows the rotating cam at a constant distance. The distance is thereby suitably measured in such a manner that the hands pass over the contour of their control bodies at a small but adequate distance.

The controls to be used in the clocks according to this invention can be made not only in mechanical form but in a number of alternative ways. Alternative forms of the control(s) can be made, for example with the aid of electric servo-motors or guided electromagnets or piston and cylinder units whose position is controlled, in all instances in conjunction with subsequent mechanical actuators. The control signals needed for the control mechanism in these versions could, for example, be transmitted to the control mechanism as analogue signals obtained by scanning or as digital signals called up from a data memory.

In a further form of the clock it is foreseen that the means for the tilting and turning bearings for the hands, and the relevant controls are positioned on the rear side of the clock face which cannot be seen and that the hands extend outwards from the center of the clock face, then round the external radial edge of the face and then extend in front of the clock face in a radial direction preferably extending over less than half the diameter of the clock face. In this version of the clock the arrangement and the course of the hands are relatively closely related to conventional clocks, such that the particular optical attraction of a clock of this type lies particularly in the shape of the clock face and in the movement of the hands.

One form of the clock alternative to the version described above foresees that the means for the tilting and rotating bearings for the hands and the related controls are arranged on the rear side of the clock face which cannot be seen and that the hands extend outwards from the center of the rear side of the clock face towards the outside and then round the radial external edge of the clock face and then radially towards the inside and then in front of the front side of the clock face in a radial direction, preferably over less than half the diameter of the clock face. In this version of the clock, the face is not only shaped differently from conventional clocks, but the arrangement and the movement of the hands are clearly different from conventional clocks. The observer can only see those sections of the hands on the external perimeter and those moving on the visible side, while the central area of the clock face on its front side can remain free of figures and control mechanisms. If the clock has several hands, differentiation, for instance into hour, minute and second hands, can be achieved by the length and/or width of the visible areas of the hands, or also by an additional or alternative coloring.

In the most recently described version of the clock, there is also the possibility of adding at least one additional functional element at least in the central area of the front of the clock face over which the hands do not pass, particularly a light and/or a text or advertising vehicle and/or a decorative item. The clock in this version therefore offers at least one additional use, as well as indicating the time, which increases the attractiveness of the clock further.

The face of the clock which is the subject of this invention can take many geometric shapes. A first, preferred, form foresees in this respect that the surface of the clock face is formed from two partial surfaces which intersect with each other at their base at an angle $\alpha$ which is not equal to 180°. In this way a clock face is created which, expressed in visual terms, has a crack in its surface. The two partial surfaces could, for example, be semi-circles or even other simple or complicated surfaces which together form the clock face. If angle $\alpha$ between the two partial surfaces is selected to be 90°, the clock which is the subject of this invention can be, for example, be installed in an internal corner between two walls intersecting each other at an angle of 90°; if the angle $\alpha$ is selected to be 270°, it is possible, for example, to install the clock on the external corner of a wall. In order to avoid sharp edges, the transition between the two partial surfaces can be rounded to a greater or lesser degree or be formed as a polygon.

An alternative development foresees that the surface of the clock dial is composed of three partial surfaces with edges running radially, whereby the partial surfaces intersect with each other at their edges which run radially at an angle $\alpha$ which is not equal to 180°. In this version of the clock the three partial surfaces can, for example, be composed of three segments of a circle of equal size, which together form the clock face whereby this is composed of three partial clock faces in different spatial planes. If an angle $\alpha$ is selected to be 90° between the partial surfaces of the clock face, a clock face is produced which, for example, can be positioned in the corner of a room in which two walls and a ceiling or a floor surface intersect with each other.

With respect to the angle $\alpha$ between the partial surfaces of the two versions of the clock explained above, the preference is for the angle to be between 90° and less than 180° or between more than 180° and 270°. If angles $\alpha$ from the above-mentioned ranges are used, clock faces can be formed which can be suitably mounted on internal corners or on external corners of walls or furniture or other suitable surfaces. In these cases, also, the transitions between the partial surfaces can be rounded, as mentioned above.

A third alternative form suggests that the surface of the clock face, when looked at in a clockwise direction, is formed of differing wave or zig-zag shaped heights arranged in a regular or irregular pattern. It is quite possible to indicate and read the time, as required, on such surface shapes on the clock face of this type which appear to be complicated at first sight, as the hands follow both the changes in height and also any alteration in the surface orientation of the clock face due to the bearing arrangements of the hands which enable rotational and pivoting movements and due to the related controls.

In order to achieve a construction of the mechanical components which drive the hands which is as compact as possible, the preference is for the clock to have a modified clockwork mechanism which is preferably suitable for remote control and for the clock-work mechanism to have the means for the pivoting and rotating bearings for the hands and the control(s) combined into an integrated clock-work drive unit.

If, on the other hand, it is important for a manufacturer of the clock which is the subject of this invention to limit the expense involved in its construction and manufacture, and in particular to be able to use as many normal clock components as possible, it is alternatively suggested that the clock has a conventional clock-work mechanism and that the means for the pivoting and rotating bearing mechanism of the hands and the control(s) are combined into a secondary motion which has input arbors which are meshed with motion arbors of the clock-work mechanism.

The clock which is the subject of this invention can, as described above, be designed as a wall clock; a design as a free-standing clock or as a suspended clock is also possible. The clock can be made for use indoors or, subject to the necessary weather-resistant design of the clock components or with a water-proof housing, can be made for use outside buildings in the open air. Finally, the clock which is the subject of the invention can be made to be worn on the body when manufactured on a sufficiently small scale. However, because of the special recognizeability of the optical effects on the movement of the hands achieved by the clock which is the subject of this invention, manufacture of the clock as a large clock is preferable.

BRIEF DESCRIPTION OF THE DRAWING

The following lists examples of models of the invention which are explained by means of a drawing. The figures show.

DETAILED DESCRIPTION OF THE PREFERRED EMBODIMENT

Figure 1:
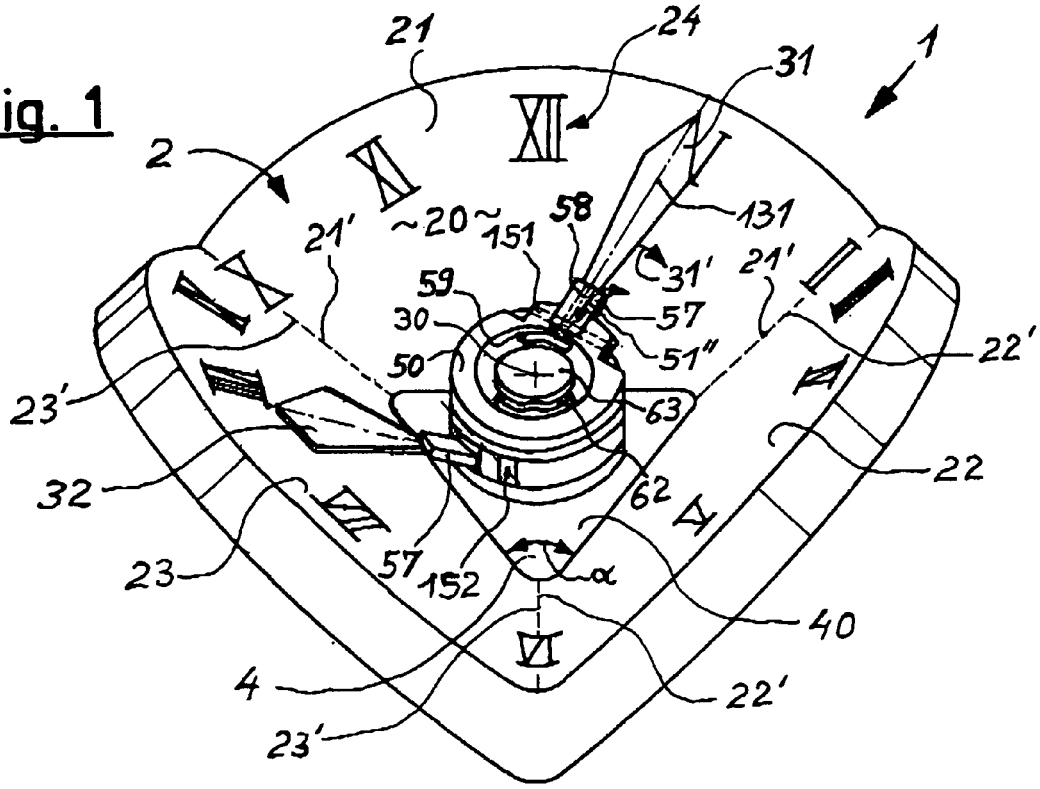
FIG. 1 illustrates a clock in an initial form, viewed from in front, but at an angle.

As FIG. 1 shows, the first example depicted here of a clock 1 has a face 2, composed of three equally sized segments of a circle 21, 22, 23. The segments of a circle 21, 22, 23 intersect with each other along their radial edges 21', 22', 23' and each encloses an angle $\alpha$ of about 90°, whereby the transition from one circular segment 21, 22, 23 to the adjacent segment 21, 22, 23 is slightly rounded. The three segments 21, 22, 23 together form the surface of the clock face 20 on which FIGS. 24 in the form of roman numerals I to XII are mounted to indicate the time. In this instance the transitions between the segments, expressed as times of day, are to be found at 2 o'clock, 6 o'clock and 10 o'clock.

Because of this shape of the clock face 2, the clock 1 can be mounted inside the upper corner of a room in which the segment 21 is parallel to a ceiling and the two segments 22 and 23 run parallel to a left and right wall, with the walls and the ceiling each enclosing an angle of 90° between the other.

In addition, the clock 1 in FIG. 1 has two hands 31, 32 of which hand 31 is the minute hand and hand 32 is the hour hand. The hands 31, 32 are elongated and two-dimensional and are pointed at their outer end. They are, for instance, stamped from a sheet and can be colored. At their inner end, the hands 31, 32 each run in a journal 58 which extends along the longitudinal orientation of the hand and which is positioned in a rotating pivoting component 57 around an axis of rotation 131, 132 which can pivot in the longitudinal orientation of a hand.

A dual-purpose pivoting and rotating control 5, 6 is arranged in the center of the clock 1 to which the hands 31, 32 are linked by their inner end in such a manner that they can move, each around two different axes, to be precise each around a pivoting axis 151 and a rotating axis 131. The pivoting axis 151, 152 of each hand 31, 32 is perpendicular to the longitudinal orientation of the hand and perpendicular to the rotational axis of the hand; this allows each hand 31, 32 to be pivoted in the direction of the curved arrow 51". The axes of rotation 131 of the rotating bearings formed by the journals 58 run along the longitudinal orientation of the hands.

There are stationary control mechanisms with mechanical cams which are covered and cannot be seen in FIG. 1 inside the pivoting and rotating controls 5, 6, the purpose of which is to pivot and rotate the hands 32, 32 relative to the clock face 2 around their pivoting and rotational axes 151, 152 in such a manner that the hands 31, 32 are guided over the clock face 2 which is not symmetric to the rotation in a clockwise direction 31' while remaining always in a relatively small and as far as possible uniform distance from and parallel to the surface of the clock face 2. In doing so, the hands 31, 32 must be pivoted downwards, that is to say to their lowest extent, in the region of the radial edges 21', 22', 23' the segments 21, 22, 23, whereas they are pivoted to reach their highest position in the region of the middle of each segment surface 21, 22, 23. In order to maintain their position parallel to the surface, the hands 31, 32, 33 are simultaneously rotated about their axis of rotation 131 to a suitable extent. The fastest rotation of the hands 31, 32 around their longitudinal axis occurs when passing over the edge areas 21', 22', 23'; the rotation is correspondingly slower in the intermediate areas of the movement of the hands 31, 32. The extent and speed of the rotation of the hands around their longitudinal axis is determined by a corresponding curve on the cams.

A modified clock-work mechanism 4 which is not visible here is foreseen under the pivot control 5, 6 and which is covered by a cover 40. The clock-work mechanism 4 is made in the form of an integrated clock-work drive unit, being combined with the pivot and rotational control 5, 6, which creates the time-dependent movement and the pivoting and rotating motion of the hands 31, 32 required by the clock face and transmits the movement to the former.

Although in the case of clock 1 the clock face 2 forms a surface which is not symmetric in the direction of the rotation of the hands 31, 32, the hands 31, 32 still move during their rotation at a distance from the clock face 2 which is, as far as possible, constant and relatively small as well as being parallel to the surface, so that in spite of the geometrically complicated and unusual shape of the clock face 2, a precise indication and reading of the time is guaranteed.

Figure 2:
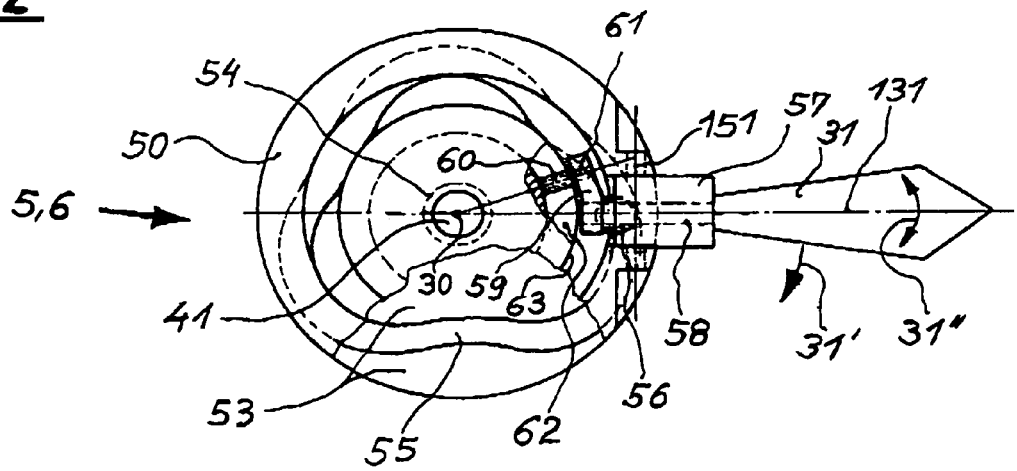
FIG. 2 illustrates a plan view of a control mechanism for a hand as a part of the clock depicted in FIG. 1.

FIG. 2 shows a plan view, partly cut away, of the dual-purpose pivot and rotational control 5, 6 which is placed in the center of the clock 1 as in FIG. 1, whereby for the sake of clarity only part of the minute hand 31 is shown, which is approximately in the 3 o'clock position in FIG. 2.

In FIG. 2 the pivot and rotating control 5, 6 is covered on its upper side which is facing the observer by an extensive rotating disc 50 which carries the hand 31 at its edge in its transverse pivoting joint 51 with the pivoting axis 51' and in the axial pivot bearing 58 with the rotating axis 131 which coincides with the longitudinal axis of the hand in such a manner that the hand can pivot and rotate. The disc 50 is linked inside the pivot and rotational control 5, 6 by a linkage which is not depicted in detail with a motion arbor 41 of the clock-work mechanism 4 which is in the background and which cannot be seen, in such a way that the disc 50 moves 360° in an hour along with the minute hand 31 in a clock-wise direction 31' around the axis of rotation of the hands.

A stationary cam 53 is mounted under the rotating disc 50 as a stationary control mechanism, which has an aperture 54 in its center for the motion arbor 41 or for the linkage mentioned earlier. In addition, the cam 53 has in its upper side which faces the underside of the disc 50 a circumferential control groove 55. A control lever 56 is restrained in this control groove 55 by one end whereby the other end of the control lever 56 is rigidly connected with the inner end of the pivoting component 57 carrying the hand 31. As FIG. 2 clearly shows, the distance of the control groove 55 varies from the motion arbors 41 when looking towards the circumference. This causes the control lever 56 which is restrained in the control groove 55 to change its orientation during the rotation of the hand 31. This orientation change in the control lever 56 is transmitted via the pivoting component 57 to the hand 31 in such a manner that the latter is correspondingly pivoted in the pivot bearing 51 around the pivot axis 51' transversely to its longitudinal orientation according to the principles of levers, as is indicated by the curved arrow 51" in FIGS. 1 and 3. The further the control groove 55 and the control lever 56 which is restrained in the former move away from the central motion arbor 41, the further the hand 31 is pivoted upwards; conversely, the hand 31 is pivoted further downward, the closer the control groove 55 and the control lever 56 it restrains approach the motion arbor 41. The required effect is achieved by adapting the shape of the control groove 55 to the shape of the clock face 2, namely, the guidance of the hand 31, and similarly of hand 32 not shown in FIG. 2, at a relatively small and essentially constant distance over the clock face 2 independently of the time of the day and the related position of the hands 31, 32 during their rotation.

A stationary cylindrical control drum 63 is arranged under the rotating disc 50 and over the cam 53 as part of the additional rotational control 6; the stationary cylindrical drum 63 also has an aperture in its center for the motion arbor 41 or the linkage previously mentioned. In addition, the control drum 63 has a circumferential control groove 62 in its perimeter. A second control lever 59 is restrained in this control groove 62, pointing in the direction of the perimeter of the control drum 63 at one end, which is formed by a roller 60 positioned on a stud 61. The other end of the control lever 59 is linked rigidly with the journal 58 forming the radially inner end of the hand 31, which is positioned in the pivoting component 57 in such a manner that it can rotate. In order to achieve the desired rotational movement of the hand 31 around its axis of rotation 131, the distance of the control groove 62, when seen in an axial direction, varies from the face of the control drum 63 facing the observer. This causes the control lever 59 restrained in the control groove 62 to alter its orientation during the rotation of the hand 31. This alteration in the orientation of the control lever 59 is transferred to the hand 31 in such a manner that the latter is correspondingly pivoted in the pivoting component 57 around the pivot axis 131 according to the principles of levers, as indicated by the curved arrow 31" in FIG. 2.

The pivoting and rotating control 5, 6 contains two control grooves 55, 62 for each hand 31, 32 of the clock 1 such that each hand 31, 32 is suitably pivoted around its transverse axis and rotated around its longitudinal axis to a suitable degree during its passage over the clock face 2 in such a manner that the desired constant distance and the parallelism to the surface of the hands 31, 32 at a short distance over the clock face 2 is guaranteed. At the same time and as in conventional clocks, differential heights of the hands 31, 32 relative to each other and relative to the motion arbor is foreseen such that they do not contact each other when one is overtaking the other. If required, the clock 1 can naturally be provided with a second hand controlled in the same manner.

Figure 3:
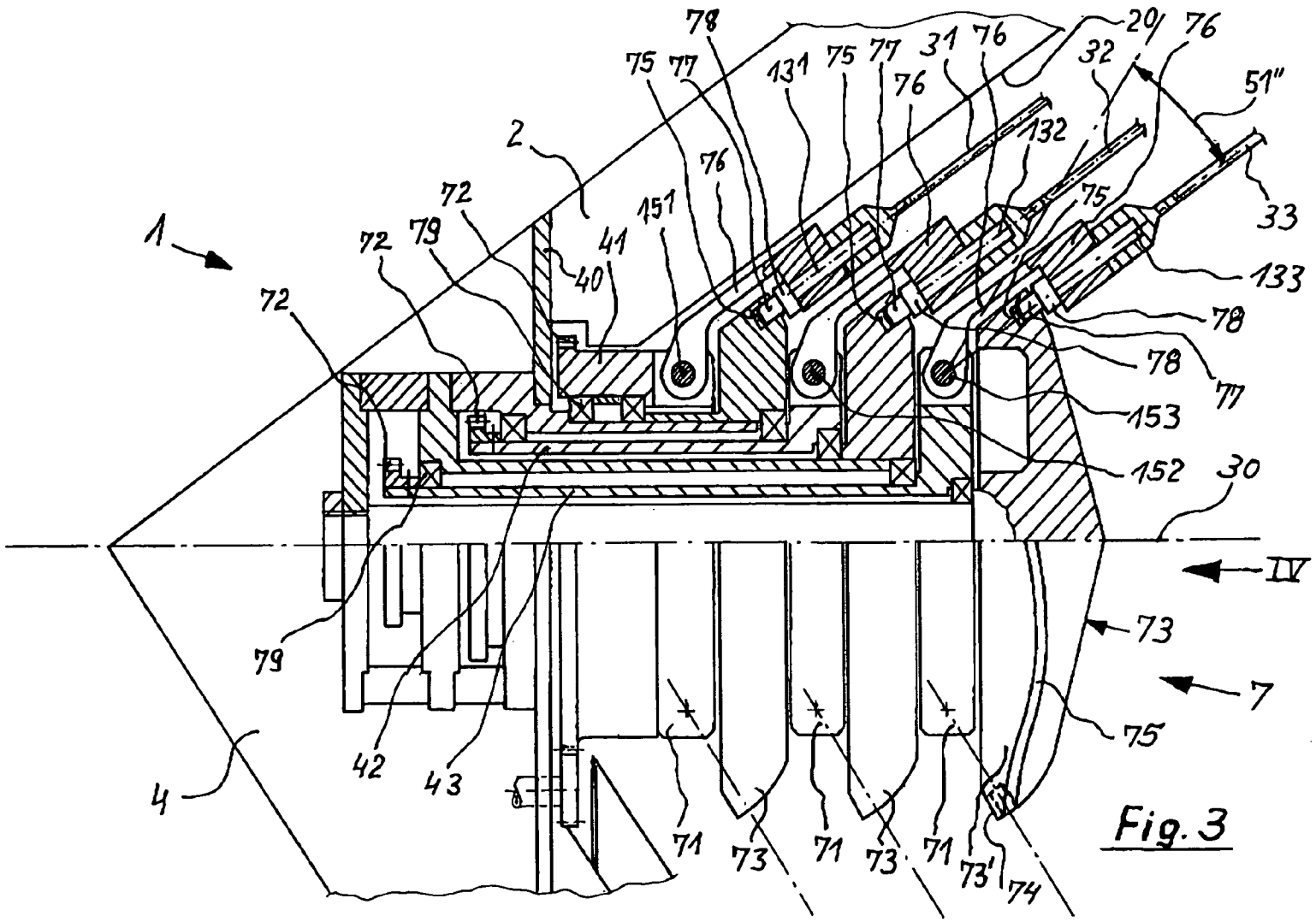
FIG. 3 illustrates the clock in a second form with three hands, in the upper half predominantly in section and as an elevation the lower half.
Figure 4:
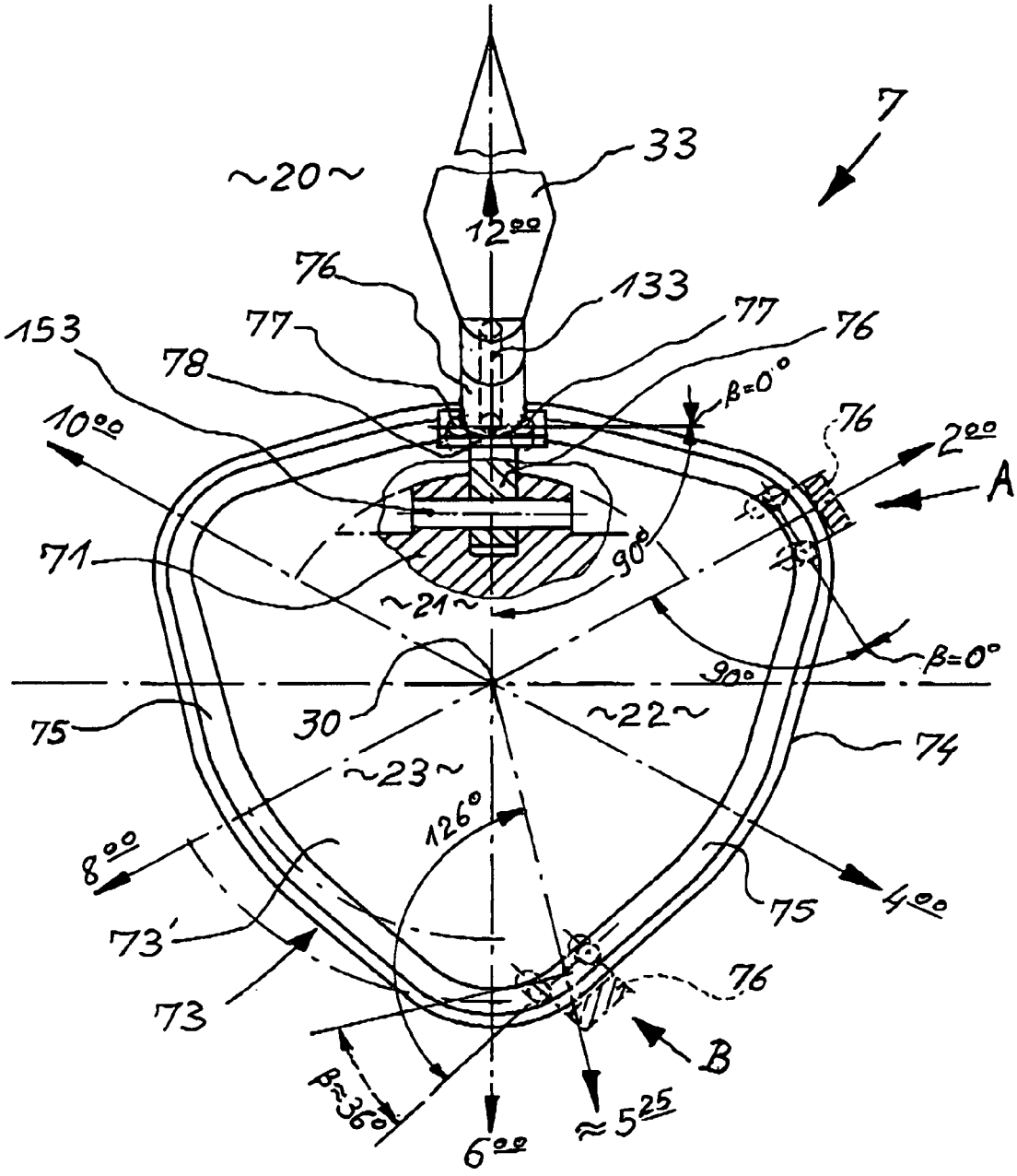
FIG. 4 illustrates the clock from FIG. 3 in elevation in the direction of the arrow IV in FIG. 3.

An example of a clock with three hands 31, 32, 33 is shown in FIGS. 3 and 4. The clock 1 with the three hands 31, 32, 33 is shown in FIG. 3 in the upper half above the axis of rotation of the hands 30 predominantly in section, and in the lower half of FIG. 3 below the axis of rotation of the hands 30 in elevation. The clock face 2 with its surface 20 is partly visible in the background of FIG. 3; the remaining part of the face 2 is not shown in FIG. 3.

At the left hand extremity of FIG. 3 is a clock-work mechanism 4 which is covered by a cover 40 such that when looking at the clock (in FIG. 3 when looking from right to left) it is not visible. In this case a total of three motion arbors 41, 42, 43 each with a gear wheel 72 extend forward, in the example of FIG. 3 therefore to the right, whereby the arbors 41 to 43 are arranged concentrically with each other. Roller bearings 79 are provided as bearings for arbors 41 to 43 to minimize bearing friction.

Distinct from the clock in FIGS. 1 and 2, the clock 1 as in FIG. 3 has a combined pivot and rotational control 7 for the required pivoting and rotation of the hands 31 to 33 as required by the contours of the surface of the clock face 20, which in this case are the same as in FIG. 1.

At the right-hand end of each of the arbors 42 to 43 is a carrier disc 71 for one of the hands 31 to 33, the carrier disc 71 being attached such that it cannot rotate. In FIG. 3 all three hands 31 to 33 are in the 12 o'clock position. A control component 73 is positioned between any two adjacent carrier discs 71 and to the right of the outside right-hand carrier disc. These control discs 73 are all fixed in position and therefore do not rotate. Each control disc 73 has the shape of a flat cone or the stump of a cone with a conical cover 73'. A cam 75 in the form of a groove is arranged in each conical cover, the groove running around the whole of the control body 73 or its cover 73' and has the shape of an oscillating curve.

One of the hands 31 to 33 is flexibly anchored to each of the carrier discs 71. For this purpose a control lever 76 forming the lower end of the hand 31, 32, 33 is positioned on the relevant carrier disc 71 in a pivoting linkage with a pivot axis 151, 152, 153, the control lever 76 being able to pivot. The pivot axes 151 to 153 run transversely to the rotation axis of the hands 30 and transversely to the longitudinal orientation of the hand. The conical cover 73' can be seen in the section and can be made with a gently rounded or spheroidal shape, whereby the rounded or spheroidal shape follows the relevant pivot axis 151, 152, 153. Furthermore the remaining part of the relevant hand 31 to 33 is positioned in each control lever 76 so that it can rotate around an axis of rotation 131, 132, 133 which runs in the longitudinal axis of the relevant hand 31, 32, 33. A roller carrier 78 with a pair of guide rollers 77 is attached to the bottom end of each hand 31, 32, 33 which projects from the control lever 76 radially towards the inside. The rollers of each pair of guide rollers 77 are inside the relevant cam 75 and are guided inside the latter. The guide rollers of the guide roller pair 77 have a fixed distance from each other in the longitudinal direction of the cam.

When the hands 31, 32, 33 are rotated by the clock-work mechanism 4, the guide rollers of the pairs of guide rollers 77 of all control levers 76 are moved by their appropriate cam 75 which brings about two movements of the hands 31 to 33: a change in the distance of the cam 75 from the axis of rotation of the hands 30 to 33 causes the hands 31 to 33 to pivot around their pivot axis, which is illustrated for hand 33 by curved arrow 51"; a change in the slope or direction of the cam 35 causes the fingers 31 to 33 rotate around their rotational axes running in their longitudinal orientation 131 to 133. In this manner a movement of each hand 31 to 33 is achieved whereby it moves in its rotation both at an essentially constant distance from and parallel to the surface 20 of the clock face 2, even when this has a geometrically unusual and complicated shape as, for example, FIG. 1 clearly shows. Thus in the case of clock 1 in FIG. 3 this combined pivoting movement and rotation of the hands 31 to 33 is achieved by a combined control mechanism 7 with the control components 73 and the other parts already described. This permits a particularly compact construction with relatively few individual components.

FIG. 4 shows the clock 1 from FIG. 3 in a front view in accordance with the line of sight IV in FIG. 3. In this, the view falls on the cover 73' of the external or upper control component 73 to be found at the extreme right of FIG. 3. The axis of rotation of the hands 30 is visible in the center of the control component 73, the axis of rotation of the hands 30 here being perpendicular to the plane of the drawing. In addition the circumferential groove-shaped cam 75 in the cover 73' of the control component 73 is visible. This cam 75 closely follows the external contour 74 of the control component 73 in order to prevent the collision of the rotating hand, in this case the relevant hand 33, with its control component 73 in its rotation around the axis of rotation of the hands 30.

For reasons of clarity only the hand 33 is illustrated, which is shown again in the 12 o'clock position. In its radially external area the hand 33 has a two-dimensional form with a relatively large width. The hand 33 takes a form which is round in cross section towards its foot. The hand 33 lies in this part inside the control lever 76 and is positioned in the latter so that it can rotate around the axis of rotation longitudinal to the orientation of the hand 133. The guide roller carrier 78 lies behind the control lever 76 with the guide roller pair 77 which is guided in the cam 75. The pivot bearing with the pivot axis 153 follows further towards the center, around which the hand 33 can be pivoted in a plane perpendicular to the plane of the drawing.

The clock face 2 with its corresponding clock face surface 20 which is in the background of FIG. 4 corresponds in shape to the clock face in FIG. 1. The clock face 2 in FIG. 4 also has three segments 21, 22, 23 which together form the surface of the clock face 20. The 12 o'clock position of the hand 33 shown in FIG. 4 is in the middle of the surface of the upper segment surface 21. As the hand 33 is moved onwards in its direction of rotation by the clock-work 4, a combined, controlled pivot movement and rotation of the hand 33 around the pivot axis 153 and the rotational axis is achieved by the pair of guide rollers 77 via the guide roller carrier 78 and the control lever 76. The pivot position of the hand 33 and of the further hand 31 not depicted here is determined by the distance of the relevant cam 75 from the axis of rotation of the hand 30. The nearer the cam 75 is to the axis of rotation 30, the further the hand 33 is pivoted at its free end in FIG. 4 towards the observer, or, to put it in more general terms, towards the axis of rotation of the hands 30; conversely, the further the hand 33 is pivoted at its free end away from the observer or, to put it in more general terms, away from the axis of rotation of the hands 30, the further the cam 75 is from the axis of rotation of the hands 30. The minimum distance of the cam 75 from the axis of rotation of the hands 30 occurs in this case at the positions for 12 o'clock, 4 o'clock and 8 o'clock; the maximum distance is in this position 2 o'clock, 6 o'clock and 10 o'clock. The rotational position of the hand 33 around its axis of rotation 133 is determined by the slope or direction of the cam 75 between the two control rollers of the control roller pair 77. The course of the cam is executed in such a way that such a rotation of the hand 33 around its axis of rotation 133 is produced that the hand in its two-dimensional external part is guided parallel to the clock face surface 20. As FIG. 4 demonstrates, the greatest changes in the slope or direction of the cam 75 are to be found in the vicinities of the 2 o'clock, 6 o'clock and 10 o'clock positions where the individual surface segments 21 to 23 of the clock face 20 adjoin. In the intermediate areas the cam 75 is flatter and has a smaller change in its slope or direction as the surfaces of the segments 21 to 23 in these areas are flat.

In FIG. 4 in the region of arrows A and B, a position of the control lever 76 at 2 o'clock and at approximately 5:25 respectively is indicated in addition to the 12 o'clock position. In such cases the angle of rotation β is indicated, which the finger 33 takes up as its basic position (=0°).

Thus the control 7 provides guidance for each of the fingers 31 to 33 by only one cam 75 for each, such that the relevant finger 31 to 33 is guided over the surface of the clock face 20 both at an essentially constant distance from and parallel to the surface.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A clock having a clock face with at least one hand and having a clock-work mechanism with at least one concentric motion arbor to move the hand around an axis of rotation of the hand, in which the clock face, when viewed in a clock-wise direction, has a surface which is not symmetric to the rotation, in which the at least one hand is pivotably anchored at an inner end which is adjacent to the axis of rotation around a second axis perpendicular to the axis of rotation and perpendicular to a third pivoting axis which runs in the same plane as a longitudinal axis of the hand in such a way that it can pivot, and in which a control is provided with which the hand can be pivoted about the second axis of rotation in such a manner that it moves over the surface of the clock face at an essentially constant distance, wherein the hand, at or near its inner end which is facing the first axis of rotation, is attached around the third axis of rotation running longitudinally to the hand in such a manner that it can rotate, the hand is two-dimensional in its visible area, and an additional control is provided with which the hand can be rotated around the third axis of rotation along its longitudinal orientation such that in its rotation it moves essentially parallel to the surface of the clock face.

2. A clock according to claim 1, wherein the additional control is a rotational control located in the center of the clock which is formed by a mechanical cam with one such cam for each hand, the curvilinear form of which is made according to the course of the clock face surface when viewed in a clock-wise direction, each mechanical cam is formed by a stationary disc or drum with a control groove, the disc or drum being concentric with the relevant motion arbor, and a control lever linked with an appropriate hand is restrained in each control groove whereby the appropriate hand can be rotated round its axis of rotation running along its longitudinal orientation as determined by the course of the control groove as the hand circles the clock face.

3. A clock according to claim 1 wherein the control for the pivoting of the hand and the additional control for the rotation of the hand around the third axis of rotation are grouped together into a combined control.

4. A clock according to claim 3, wherein the combined control is formed by a calculated mechanical cam for each hand which is formed on or in the cover of a stationary conical or truncated cone-shaped control component concentric to the rotational axis of the hand and a control lever is restrained in a cam by a pair of control rollers with two control rollers separated from each other in the longitudinal orientation of the cam, whereby the distance of the cam from the axis of rotation of the hand determines the pivot position of the hand and the slope or direction of the cam between the two guide rollers of the pair of guide rollers determines the rotational position of the hand around the third axis of rotation of the hand.

5. A clock according to claim 4, wherein the external radial contour of each conical or truncated cone-shaped control component is shaped in such a manner that it follows the rotating cam at a constant distance.

6. A clock according to claim 1, wherein at least one of the control and the additional control is formed by an electric servo-motor for each hand and successive mechanical actuators, instead of mechanical cams, with which the relevant hand is rotated around at least one of the second and third axis of rotation during its course according to electric control signals corresponding to the course of the surface of the clock face.

7. A clock according to claim 1 wherein at least one of the control and the additional control is formed by a controlled electromagnet for each hand and successive mechanical actuators, instead of mechanical cams, with which the relevant hand is rotated around at least one of the second and third axis of rotation during its course according to electric control signals corresponding to the course of the surface of the clock face.

8. A clock according to claim 1, wherein the control is formed by a position-controlled piston and cylinder unit for each hand and successive mechanical actuators, instead of mechanical cams, with which the relevant hand is rotated around at least one of the second and third axis of rotation of the hand during its course according to electric control signals corresponding to the course of the surface of the clock face.

9. A clock according to claim 1, wherein rotating and pivoting bearings of the hand and the controls are arranged on a visible side of the clock face and the hand extends outwards from a center of the clock face.

10. A clock according to claim 1, wherein rotating and pivoting bearings of the hand and the controls are arranged on a side of the clock face which cannot be seen and the hand extends outwards from a center of the clock face and then round a radially external edge of the clock face and then extend radially inwards in front of the clock face.

11. A clock according to claim 10, wherein said hand extends radially inwards over less than half of a diameter of the clock face.

12. A clock according to claim 11, wherein there is positioned at least one additional functional element in a central area over which the hand does not revolve.

13. A clock according to claim 12, wherein said additional functional element is selected from the group consisting of a light, a text, an advertising vehicle and a decorative element.

14. A clock according to claim 1, wherein the surface of the clock face is formed from two partial surfaces which adjoin each other at their base at an angle $\alpha$ which is not equal to 180°.

15. A clock according to claim 1, wherein the surface of the clock face is formed by three partial surfaces with edges running radially whereby the partial surfaces adjoin each other at their radially arranged edges at an angle $\alpha$ which is not equal to 180°.

16. A clock according to claim 14, wherein the angle $\alpha$ is between 90° and 180°.

17. A clock according to claim 14, wherein the angle $\alpha$ is between 180° and 270°.

18. A clock according to claim 1, wherein the surface of the clock face when viewed in a clockwise direction is formed of differing wave or zig-zag shaped heights arranged in one of a regular and irregular pattern.

19. A clock according to claim 1, wherein the clock has a modified clock-work mechanism suitable for remote control and the clock-work mechanism combines bearings enabling the hands to pivot and rotate and the controls into an integrated clock-work drive mechanism.

20. A clock according to claim 1, wherein the clock has a conventional, unmodified clock-work mechanism, and bearings enabling the hands to pivot and rotate and the controls are combined into a secondary motion which has input arbors which mesh with motion arbors.

21. A clock comprising:

a clock face having at least one hand, a clock-work mechanism having at least one motion arbor to move said at least one hand around a first axis of rotation of said at least one hand, said at least one hand being pivotably anchored at an inner end, which is adjacent to said first axis of rotation, around a second axis perpendicular to said first axis of rotation, and perpendicular to a third pivoting axis which lies in a plane containing a longitudinal axis of the hand, said at least one hand, at or near said inner end, being attached around said third axis of rotation running longitudinally to said at least one hand, in such a manner that said at least one hand can rotate about said third axis of rotation, said clock face, when viewed in a clock-wise direction, having a surface which is not symmetric to a rotation of said at least one hand around said first axis of rotation, a control with which said at least one hand is pivoted in such a manner that said at least one hand moves above said surface of said clock face at an essentially constant distance, an additional control with which said at least one hand is rotated around said third axis of rotation such that in its rotation about said first axis of rotation it moves essentially parallel to said surface of said clock face, said at least one hand being two-dimensional in a visible area as viewed substantially along said first axis of rotation.

* * * * *